US005522537A

United States Patent [19]

Barlow

[11] Patent Number: 5,522,537

[45] Date of Patent: Jun. 4, 1996

[54] CARTON HAVING TRIANGULAR CORNERS

[75] Inventor: David A. Barlow, London, England

[73] Assignee: Nestec S.A., Vevey, Switzerland

[21] Appl. No.: 382,285

[22] Filed: Jan. 31, 1995

[30] Foreign Application Priority Data

Mar. 1, 1994 [GB] United Kingdom ..... 9403861

[51] Int. Cl.[6] ..... B65D 17/28; B65D 5/20

[52] U.S. Cl. ..... 229/109; 229/103; 229/113; 229/186; 229/242; 229/903

[58] Field of Search ..... 229/103, 103.2, 229/109, 240, 242, 902, 903, 906, 113, 114, 186; 426/113, 114, 115, 122; 99/DIG. 14; 219/10.55 E

[56] References Cited

U.S. PATENT DOCUMENTS

| | | | |
|---|---|---|---|
| 2,808,191 | 10/1957 | Cramer | 229/904 |
| 3,281,051 | 10/1966 | O'Brien et al. | 426/113 |
| 3,324,999 | 6/1967 | Farquhar | 229/103 |
| 3,756,471 | 9/1973 | Wissman | 229/242 |
| 3,853,259 | 12/1974 | Tupper | 229/103 |
| 4,202,465 | 5/1980 | McLaren | 229/903 |
| 4,451,001 | 5/1984 | Webinger | 229/114 |
| 4,592,914 | 6/1986 | Kuchenbecker . | |
| 4,661,671 | 4/1987 | Maroszek | 99/DIG. 14 |
| 4,821,884 | 4/1989 | Griffin et al. | 229/903 |
| 4,836,383 | 6/1989 | Gordon et al. | 229/903 |
| 4,992,638 | 2/1991 | Hewitt et al. . | |
| 5,000,374 | 3/1991 | Deiger | 229/906 |
| 5,014,905 | 5/1991 | Cassidy | 229/113 |
| 5,110,039 | 5/1992 | Phillips | 229/906 |
| 5,270,502 | 12/1993 | Brown et al. | 426/113 |

FOREIGN PATENT DOCUMENTS

| | | | |
|---|---|---|---|
| 0536103 | 4/1993 | European Pat. Off. . | |
| 2545062 | 11/1984 | France . | |
| 2691947 | 12/1993 | France | 229/113 |
| U8506189 | 6/1985 | Germany . | |
| 694537 | 7/1953 | United Kingdom . | |
| 2065072 | 6/1987 | United Kingdom . | |

*Primary Examiner*—Gary E. Elkins
*Attorney, Agent, or Firm*—Vogt & O'Donnell

[57] ABSTRACT

A carton has a top wall having eight side edges which circumscribe a top wall surface area and a bottom wall having four side edges which circumscribe a bottom wall surface area. Four trapezoidal side walls, each having a major edge, a minor edge and two side edges, extend between the top wall and the bottom wall, such that the major edges of the sidewalls abut, respectively, adjacent of the side edges of the bottom wall and such that the minor edges of the sidewalls abut, respectively, alternate of the side edges of the top wall. The carton has four triangular corner wall portions, each having a base, which abuts the top wall at a position displaced inwardly from one of the top wall edges that does not abut one of the minor edges of the side walls, and two sides, one of which abuts one of the side edges of one of the adjacent side walls. A device for opening the carton is positioned in one of the trapezoidal side walls, and a line of weakness is positioned in the bottom wall or in the top wall. Upon tearing, the line of weakness forms an aperture circumscribed by a rim for receiving and supporting a container.

12 Claims, 3 Drawing Sheets

CARTON HAVING TRIANGULAR CORNERS

BACKGROUND OF THE INVENTION

The present invention relates to a carton for containing a food product in a container which may be removed from the carton for cooking for consumption. The carton is adapted to provide a supporting means for the container containing the cooked food product.

When consuming convenience food products, it is sometimes desirable to be able to eat the food product directly from the container in which the food product has been cooked or reheated. However, since the container is usually too hot to handle after cooking, the consumer may prefer to pour the contents onto a plate or support the container on the plate which later has to be washed. The present invention provides a carton which is adapted to provide a supporting means for the container containing the cooked food product.

SUMMARY OF THE INVENTION

Accordingly, the present invention provides a carton for containing a container which contains a food product in a container. The carton is provided with means for permitting the container to be removed from the carton. The carton has a line of weakness provided in one of the walls of the carton having an outline corresponding substantially to the perimeter of the container. The line of weakness defines a disc which can be removed by hand to leave an aperture on whose rim the container may be supported.

The invention further provides a blank adapted to form the carton, and a carton with a container therein.

In a modification, the carton as supplied to the customer, already has the above mentioned aperture formed therein.

DETAILED DESCRIPTION OF THE INVENTION

The carton may be made of conventional material such as cardboard, paperboard or plastics material and may conveniently be formed from a one-piece blank.

The carton preferably has a top wall, a bottom wall, and a plurality of side walls, e.g. four side walls, which define the height of the carton.

The means for removing the container from the carton may be provided by lines of weakness in a side wall defining a strip which can be torn off by hand to enable removal of the container through the side of the carton. The lines of weakness may be, for instance, perforations, notches, creases, slits, scorelines or die cuts, etc.

The line of weakness having an outline corresponding substantially to the perimeter of the container is preferably located in either the top or the bottom wall of the carton, more preferably in the bottom wall. Advantageously, a small portion of the line of weakness may extend into one of the side walls, preferably other than the side wall through which the container is removed, so that this small portion lies at right angles to the line of weakness in the top or bottom wall. The small portion is shaped to form a finger pressure tab which can act as a tear initiator so that tearing can be initiated by finger or thumb pressure.

The container for the food product may be made of any material suitable for heating a food product in an oven or a microwave cooker. It may be, for instance, a plastics tray, dish, or pot. The shape of the container may be any suitable shape which fits inside the carton, which may be easily removed from the carton and which may be supported by the rim of the aperture formed by removal of the disc having an outline corresponding to the perimeter of the container.

The container may have a perimeter wall which is square, rectangular or circular. The container may be provided with an upper rim by means of which it is supported by the rim of the aperture in one of the walls of the carton and which may be formed by removal of the disc. Alternatively, the perimeter wall of the container may slope so that it is narrower at the bottom than at the top, enabling the container to be supported at a suitable position on its perimeter wall by the rim of the aperture in one of the walls of the carton and which may be formed by removal of the disc. The container is conveniently sealed with a lid of plastics film.

The food product within the container may be frozen or refrigerated and may be a prepared meal which, after removal from the carton, can be cooked for consumption in a microwave or convection oven within about 2 minutes for a refrigerated product or about 5 minutes for a frozen product. The cooked food product may be eaten directly from the container supported on the rim of the aperture formed by removal of the disc from the wall of the carton, thus eliminating the need to use a plate and subsequent washing up.

The present invention will now be further described by way of illustration with reference to the following drawings.

DETAILED DESCRIPTION OF THE DRAWINGS

Figure 1:
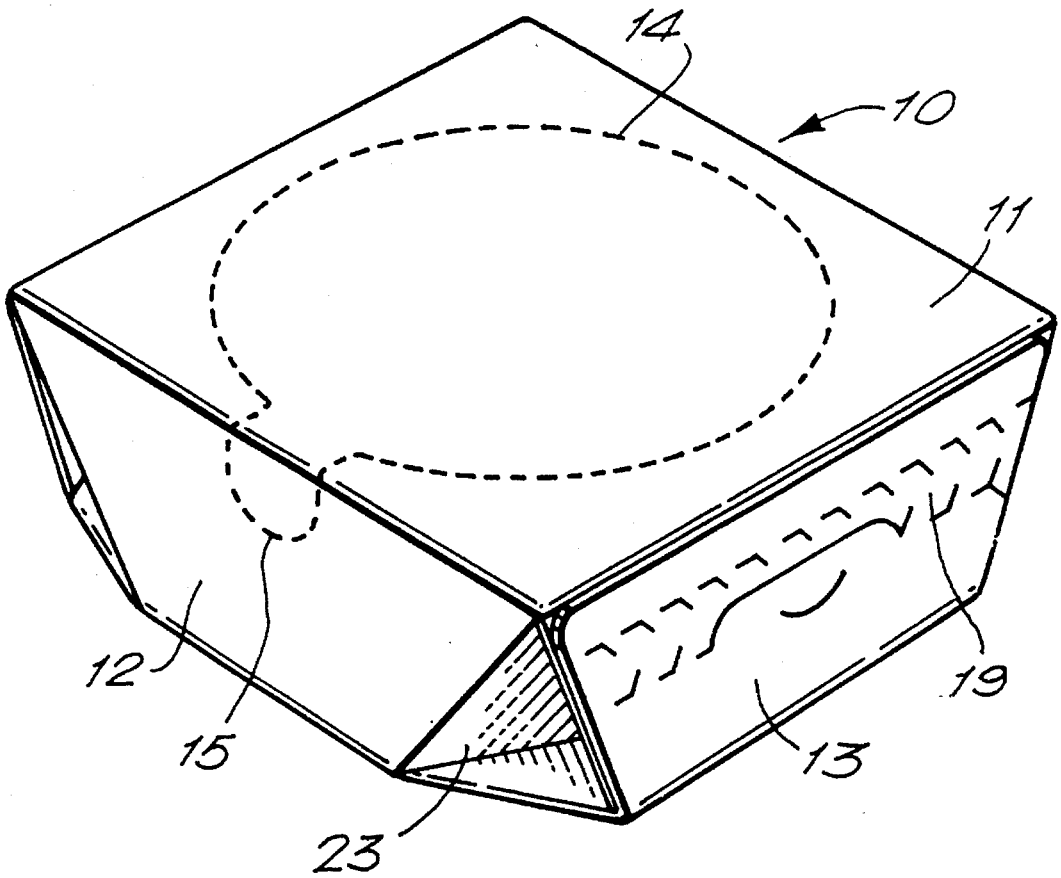
FIG. 1 represents a perspective view of the carton.
Figure 2:
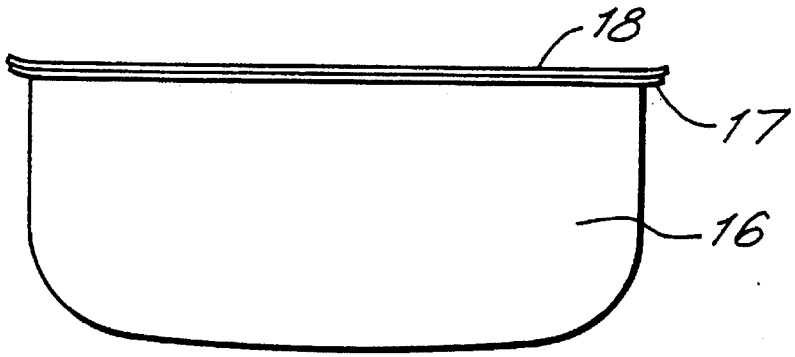
FIG. 2 represents a perspective view of a container for a food product.

Referring to the drawings in FIG. 1, the carton 10 is positioned with its bottom wall 11 facing upwards with side walls 12 and 13 visible. Perforations 14 are formed in the bottom wall 11 to define the greater part of a circle with a small portion of perforations extending into side wall 12 to form a tear initiator tab 15. The circumference of the circle defined by the perforations 14 corresponds to the circumference of the container 16 (a plastics pot) which is provided (FIG. 2), with a rim 17 and a seal 18. Side wall 13 is formed with a perforated tear strip 19. The area of the bottom wall of the carton is greater than that of the top wall.

Figure 4:
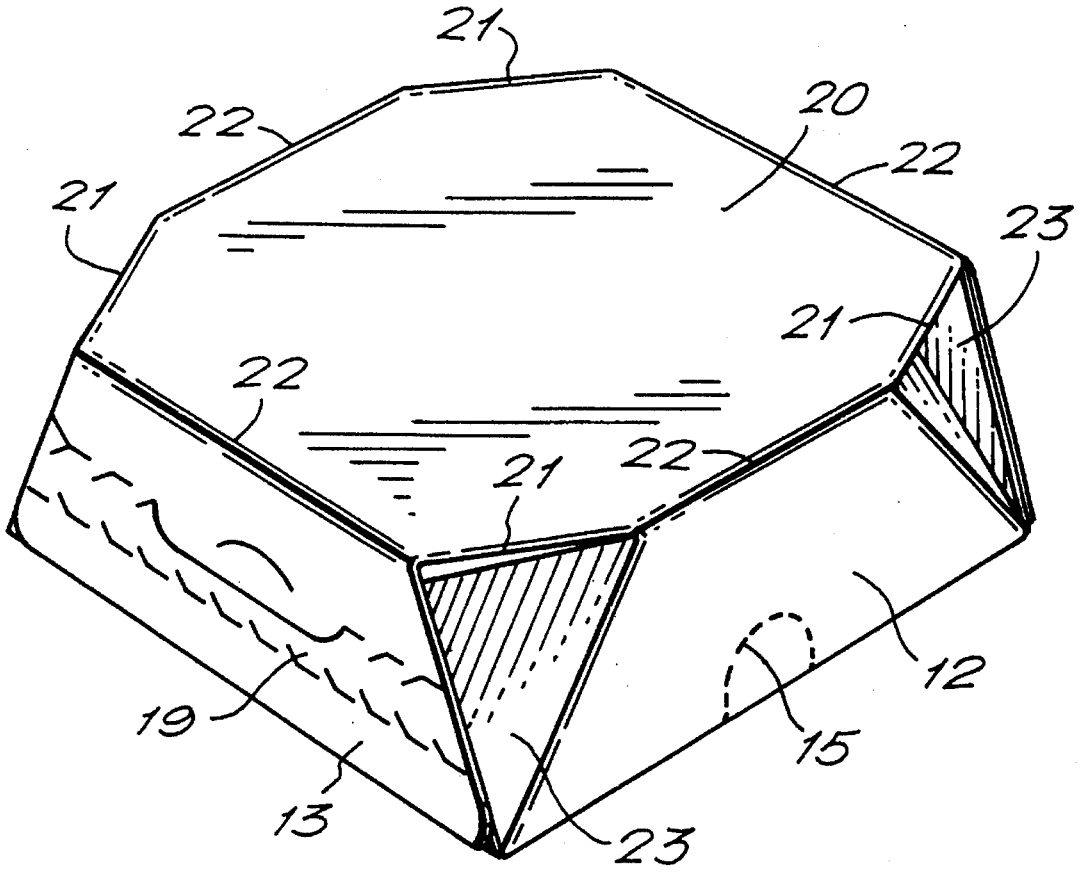
FIG. 4 represents another perspective view of the carton showing in more detail the triangular side wall portions at each of the four corners of the carton.

In operation, the container 16 containing the food product within the carton 10 is removed from the carton by tearing off the tear strip 19 on the side wall and removing the container through the opening so formed. The food product is cooked, the seal 18 removed, and the circular disc defined by the perforations 14 is removed by finger pressure on the tear initiator tab 15 which is then gripped to tear off the disc to leave a hole. As illustrated in FIG. 4, the carton is placed with its top wall 20 downwards and then the plastics pot is placed on the rim of the hole formed by removal of the disc where it is supported, enabling the consumer to eat the food product contained therein.

Figure 3:
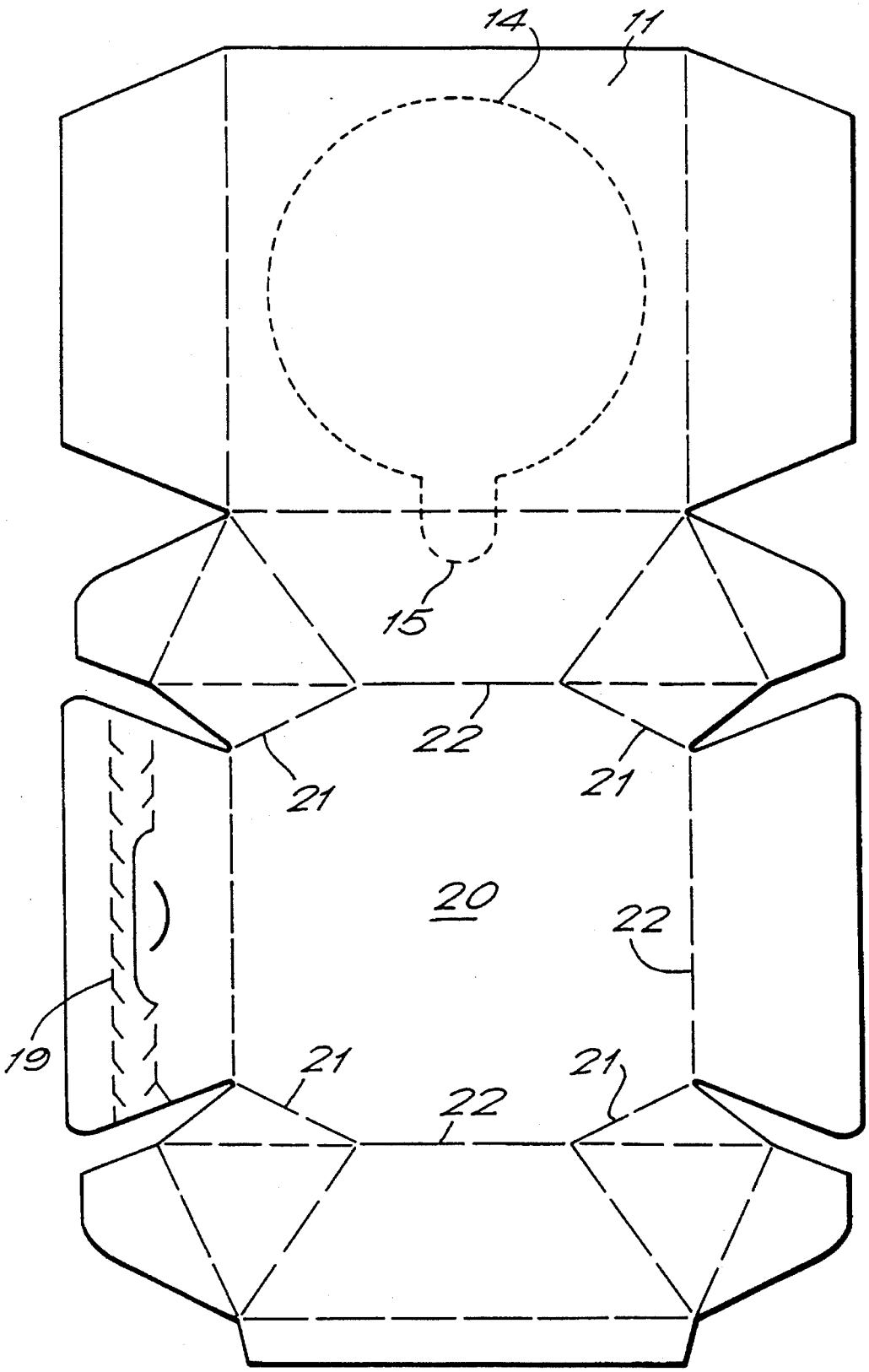
FIG. 3 represents a blank from which a carton may be formed by folding.

As already mentioned, FIG. 3 shows a blank which can be used to form the carton of FIG. 1. Attention is particularly drawn to the angled fold lines 21 which, together with the connecting fold lines 22, define the top wall 20 of the carton.

The area of the top wall 20 is therefore less than the area of the bottom wall 11, and a triangular side wall portion 23 (see FIG. 1) is present at each of the four corners of the carton, interconnecting the adjacent regions of the top and bottom walls.

I claim:

1. A carton comprising:

a top wall having eight side edges which circumscribe a top wall surface area;

a bottom wall having four side edges which circumscribe a bottom wall surface area;

four trapezoidal side walls, each having a major edge, a minor edge and two side edges, each sidewall extending between the top wall and the bottom wall such that the major edges of the sidewalls abut, respectively, adjacent of the side edges of the bottom wall and such that the minor edges of the sidewalls abut, respectively, alternate of the side edges of the top wall;

four triangular corner wall portions, each having a base, which abuts the top wall at a position displaced inwardly from one of the top wall edges that does not abut one of the minor edges of the side walls, and two sides, one of which abuts one of the side edges of one of the adjacent side walls;

means for opening the carton positioned in one of the trapezoidal side walls; and a line of weakness, positioned in the bottom wall or in the top wall, which upon tearing forms an aperture circumscribed by a rim for receiving and supporting a container.

2. A carton according to claim 1 constructed from a one-piece carton blank.

3. A carton according to claim 1 wherein the bottom wall is square.

4. A carton according to claim 1 wherein the surface area of the bottom wall is greater than the surface area of the top wall.

5. A carton according to claim 1 wherein the means for opening the carton comprises a line of weakness.

6. A carton according to claim 1 wherein the means for opening the carton comprises a tear strip.

7. A carton according to claim 1 wherein the line of weakness extends onto one of the side walls to define a tear-initiating tab.

8. A carton according to claim 1 constructed from cardboard, paperboard or plastic.

9. A carton according to claim 1 further comprising a container containing food positioned inside the carton.

10. A carton according to claim 9 wherein the container has a perimeter corresponding substantially to the line of weakening.

11. A carton according to claim 9 wherein the container has an upper rim dimensioned so as to be supported by the rimmed aperture of the carton upon formation of the aperture and positioning of the container therein.

12. A carton according to claim 9 wherein the container is plastic.

* * * * *